US006409917B1

(12) United States Patent
Malone, Jr.

(10) Patent No.: US 6,409,917 B1
(45) Date of Patent: Jun. 25, 2002

(54) ACCESSORY FOR USE IN A WATER TREATMENT SYSTEM OF A SWIMMING POOL

(76) Inventor: Carl J. Malone, Jr., 113 Julianne Ct., Manhattan, IL (US) 60442-9267

( * ) Notice: Subject to any disclaimer, the term of this patent is extended or adjusted under 35 U.S.C. 154(b) by 0 days.

(21) Appl. No.: 09/919,971

(22) Filed: Aug. 2, 2001

(51) Int. Cl.[7] ..... E04H 4/14; E04H 4/16

(52) U.S. Cl. ..... 210/169; 4/496; 4/507; 210/416.2

(58) Field of Search ..... 210/169, 232, 210/416.2; 4/496, 507

(56) References Cited

U.S. PATENT DOCUMENTS

| | | | | |
|---|---|---|---|---|
| 4,092,746 | A | * | 6/1978 | Harris |
| 4,903,351 | A | * | 2/1990 | Dengel et al. |
| 4,960,514 | A | | 10/1990 | Paskert |
| 5,059,314 | A | | 10/1991 | Beckman |
| 5,259,076 | A | * | 11/1993 | Voight et al. |
| 5,279,728 | A | | 1/1994 | Weiss |
| 5,350,508 | A | | 9/1994 | Van der Watt |
| 5,948,245 | A | * | 9/1999 | Hodak |
| D433,152 | S | * | 10/2000 | Masciarelli |
| 6,128,791 | A | * | 10/2000 | Brocking |
| D433,760 | S | * | 11/2000 | Masciarelli |

* cited by examiner

*Primary Examiner*—David A. Simmons
*Assistant Examiner*—Fred Prince
(74) *Attorney, Agent, or Firm*—Donald R. Schoonover

(57) ABSTRACT

Servicing of a water treatment system of a swimming pool is facilitated by an accessory that is placed over the intake/return port of the water treatment system to fluidically isolate that intake/return port from the water in the swimming pool. The accessory is held in place by water pressure exerted thereon and water in the accessory is drained so water from the swimming pool will not flow into the water treatment system when the accessory is in place. The accessory can be used with above-ground pools as well as other pools.

5 Claims, 2 Drawing Sheets

ACCESSORY FOR USE IN A WATER TREATMENT SYSTEM OF A SWIMMING POOL

BACKGROUND OF THE INVENTION

1. Field of the Invention

The present invention relates to the general art of swimming pool accessories, and to the particular field of accessories used in servicing a swimming pool.

2. Discussion of the Related Art

Today, many homes and recreational centers have swimming pools. Some of these pools are in-ground and others are above ground. These pools generally have some form of water treatment system which generally includes a pump for moving water from the pool via a skimmer system to and through a filter system. Water moves through this water treatment system and debris as well as impurities and contaminants are removed from the water before it is re-circulated back into the swimming pool. Water treatment chemicals are also injected into the water during the water treatment process.

Sometimes, the water treatment system, itself, must be serviced. This service can include servicing individual parts of the system, cleaning the system, replacing parts of the system, conducting emergency repairs, and the like. Often, servicing the water treatment system requires dismantling all or part of the system. Water cannot flow through the system or even be located in the system if the system must be even partially dismantled.

At the present time, before servicing a water treatment system, many pools require draining at least some of the water from the pool so the water level of the water remaining in the pool is below the level of the intake/return port of the water treatment system so water does not flow from the pool into the water treatment system during servicing of the water treatment system. This may be costly and wasteful. Since the level of the water must be lowered, a large pool may lose thousands of gallons of otherwise useable water, which then must be replaced after the water treatment system is placed back on line. Not only is the water wasted, any chemicals in the water will be wasted, and energy may be wasted in reheating the newly-filled pool back to a desirable temperature. Not only is water wasted when water is removed unnecessarily, water is wasted in replacing the removed water.

Therefore, there is a need for an accessory that can be used in connection with a water treatment system of a swimming pool that will permit servicing that water treatment system without requiring the draining of a large amount of water from the swimming pool.

OBJECTS OF THE INVENTION

It is a main object of the present invention to provide an accessory for a water treatment system of a swimming pool that can be serviced without requiring the draining of a large amount of water from the swimming pool.

It is another object of the present invention to provide an accessory for a water treatment system of a swimming pool that can be serviced while requiring the removal of only a very small volume of water from the swimming pool.

It is another object of the present invention to provide an accessory for a water treatment system of a swimming pool that can be serviced without draining the pool to a level below the level of an intake/return port of the water treatment system.

It is another object of the present invention to provide an accessory for a water treatment system of an above-ground swimming pool that can be serviced without requiring draining of a large amount of water from the swimming pool.

SUMMARY OF THE INVENTION

These, and other, objects are achieved by an accessory that fits over the intake/return port of a swimming pool water treatment system in the manner of a dam to fluidically isolate that intake/return port from the body of water in the swimming pool. The accessory prevents swimming pool water from flowing to the intake/return port and thus permits the water treatment system to be dismantled if necessary.

Accordingly, the water treatment system can be serviced without requiring lowering the water level in the pool to below the level of the water treatment system intake/return port. Water that normally would be drained and then replaced will not be removed from the swimming pool.

The accessory, itself, is simple, lightweight and easy to place and remove thereby making it economical and easy to use.

DETAILED DESCRIPTION OF THE INVENTION

Other objects, features and advantages of the invention will become apparent from a consideration of the following detailed description and the accompanying drawings.

The accessory embodying the teaching of the present invention places a dam around the intake/return port of a swimming pool water treatment system to fluidically isolate that intake/return port from the body of water remaining in the swimming pool during servicing of the water treatment system. Thus, only the water located between the accessory wall and the intake/return port needs to be drained prior to servicing the water treatment system. This small amount of water can be easily replaced, or if not replaced, is so small as to not be missed when the water treatment system is returned to service.

Figure 1:
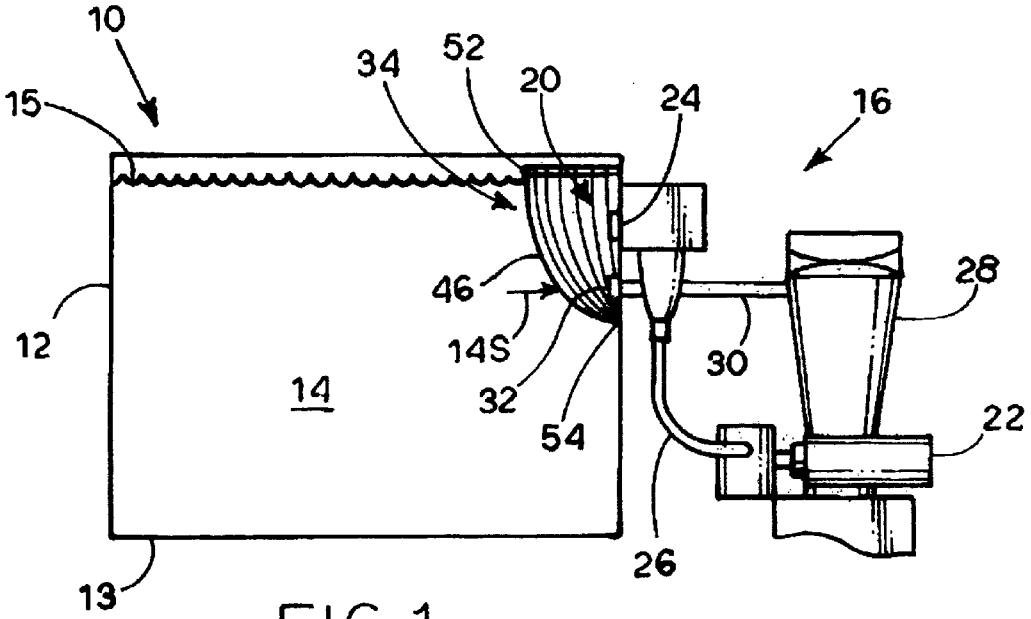
FIG. 1 is an elevational view of a swimming pool which includes a water treatment system and an accessory embodying the teaching of the present invention.
Figure 2:
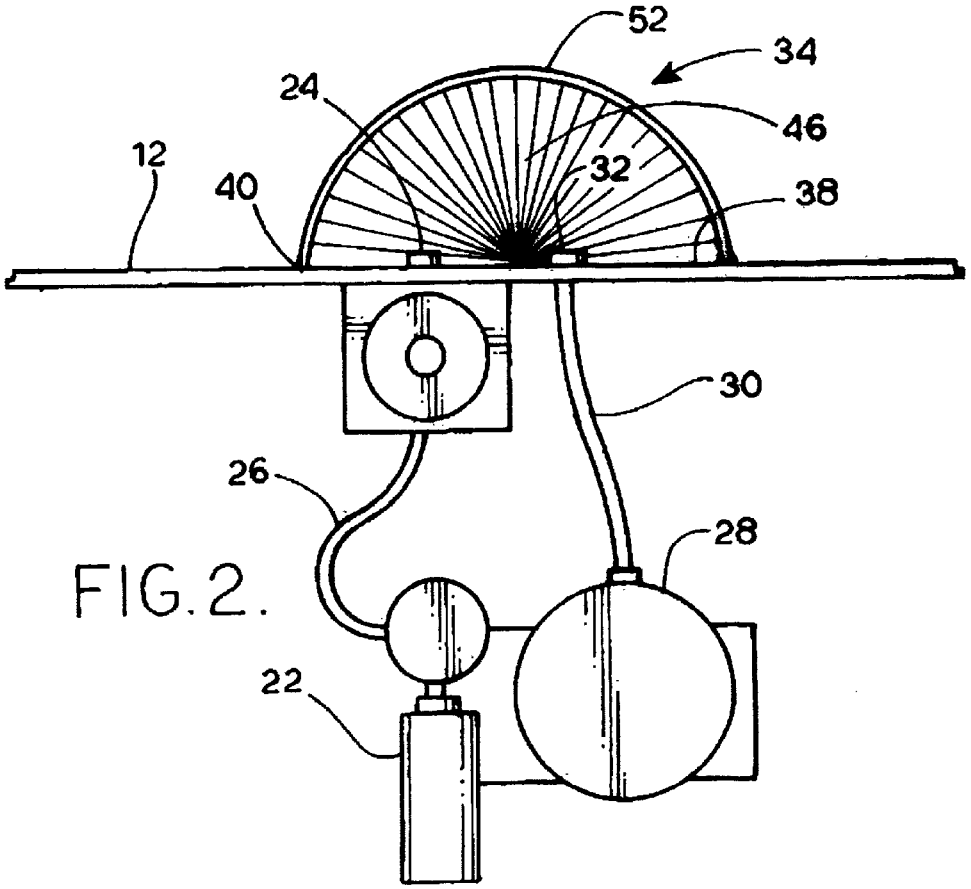
FIG. 2 is a top plan view of the accessory of the present invention in place on a side wall of a swimming pool.

Referring to FIGS. 1 and 2, a swimming pool 10 is shown as including a side wall 12 and a bottom wall 13 that co-operate to contain a body of water 14 in a manner well known in the art. Body of water 14 has a level 15 that is set according to the desires of the swimming pool operator.

Swimming pool 10 also includes a water treatment system 16 for maintaining proper clarity, purity and chemical balance of the water in swimming pool 10. Water treatment system 16 includes a port 20 that can be covered with a screen or the like, and serves as an intake/return port for the water treatment system 16 in a manner known in the art. As shown, water treatment system 16 includes a pump 22 which moves water 14 from the swimming pool 10 into the water treatment system 16, through the water treatment system 16 and back to the swimming pool 10. Water moves from intake port 24 through a water line 26 and then through a filter 28 before being returned to the swimming pool 10 via return line 30 and return port 32.

Under circumstances existing prior to the present invention, to service water treatment system 16, water level 15 had to be lowered beneath the level of intake port 24, and probably beneath the level of return port 32 as well. This lowering of level 15 was necessary to prevent water from entering the water treatment system 16 and may have involved the loss of a great deal of water that would otherwise be retained in the swimming pool 10.

The present invention overcomes this drawback by fluidically isolating the intake/return port system 20 from the body of water in the swimming pool during the overall process of servicing the water treatment system 16.

Figure 3:
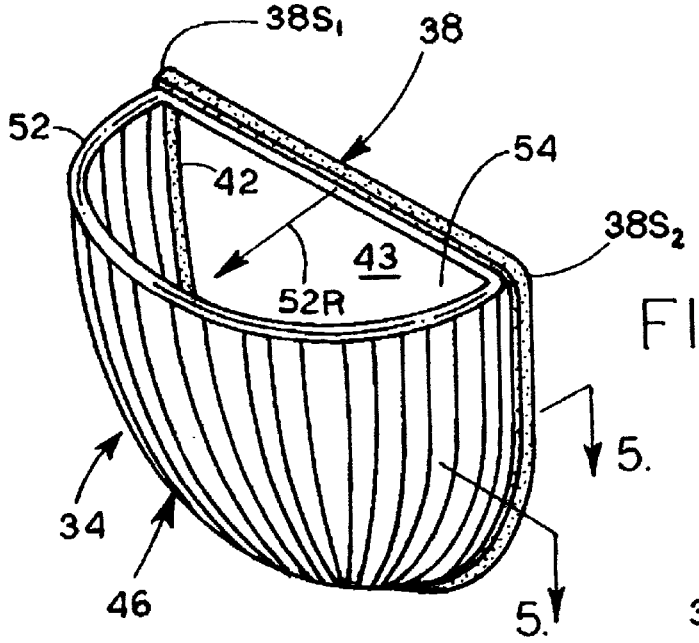
FIG. 3 is a perspective view of the accessory of the present invention.
Figure 4:
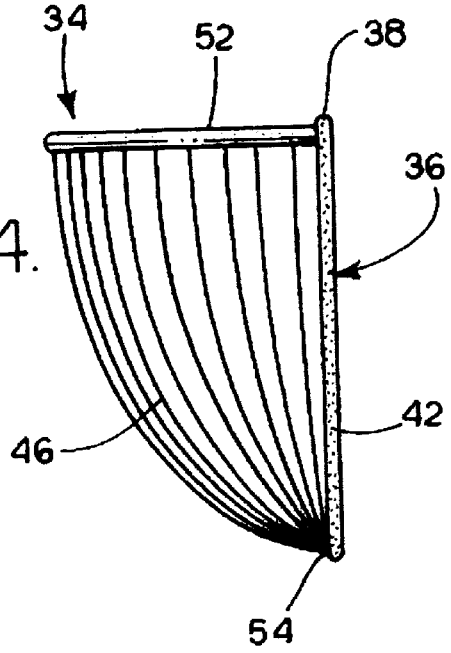
FIG. 4 is a side elevational view of the accessory of the present invention.
Figure 5:
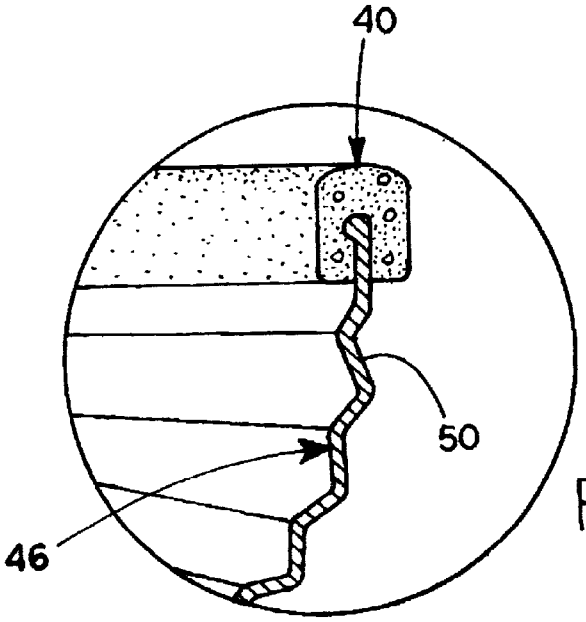
FIG. 5 is a view taken along line 5—5 of FIG. 3.

As shown in FIGS. 1 and 2, the present invention is embodied in an accessory which includes a dam 34 releasably fixed to swimming pool side wall 12 adjacent to intake/return port 20 of water treatment system 16, with dam 34 fluidically isolating intake/return port 20 of water treatment system 16 from water 14 in the swimming pool. As shown in FIGS. 3–5, dam 34 includes a first planar wall 36 having a top rim 38 and an arcuate side and bottom wall 40 that extends down from top rim 38 when dam 30 is in place on side wall 12 of the swimming pool. A unitary and monolithic seal 42 is fixedly attached to wall 36 and releasably mounts first planar wall 36 on swimming pool side wall 12 surroundingly adjacent to the intake/return port 20 of water treatment system 16. Preferably, seal 42 is rubber, but other materials can be used without departing from the scope of the present disclosure. A fluid port 43 is defined through first planar wall 36 and is located to be in fluid communication with the intake/return port 20 of water treatment system 16. Port 43 thus is in fluid communication with intake port 24 and return port 32. Port 43 covers essentially the entire area of first planar wall 36 so water freely flows to and through port 43 when desirable.

Dam 34 further includes a water-impervious wall 46 fixed to first planar wall 36. Water-impervious wall 46 is in the approximate shape of a quarter-sphere so water pressure exerted thereon by water 14 will be distributed on wall 46 in a manner that will force wall 46 toward swimming pool side wall 12 to hold dam 34 in place on side wall 12 by means of static pressure associated with the water in the swimming pool 10. This static pressure is indicated in FIG. 1 by arrow 14S and works in conjunction with seal 40 to securely hold dam 34 in place adjacent to intake/return port 20 once the dam 34 is placed on the swimming pool side wall 12. The quarter-sphere shape of wall 46 distributes the static pressure in the manner necessary to work in conjunction with the seal 42 to securely hold wall 46 in place on swimming pool wall 12. Wall 46 preferably is plastic and includes corrugations 50 to make the wall light, yet strong with the corrugated ribs strengthening the overall structure. Wall 46 has a top rim 52 which is arcuate and extends radially away from top rim 38 of wall 36 when the dam 34 is in place adjacent to the intake/return port of the water treatment system 16. Top rim 52 defines a fluid opening 54 that is fluidically connected to fluid port 42 of dam 34. As can be seen in FIG. 1, top rim 52 is essentially co-planar with rim 38 of wall 36 and is located above water level 15 and bottom rim 54 of wall 36 is located below the level of intake/return port 20 to enclose the intake/return port 20 and fluidically separate that port from the body of water 14.

Use of dam 34 can be understood from the above description, and thus will only be briefly discussed. Dam 34 is placed surroundingly adjacent to intake/return port 20 of the water treatment system 16 and held in place while water is drained out of the dam 34 with the pump 22 disconnected, or by means of pump 22 if the pump remains connected. Once water is removed from the dam 34, static water pressure will keep the dam 34 in place adjacent to the intake/return port 20. The water treatment system 16 is thus fluidically isolated from the water in the swimming pool by the dam 34. Once work on the water treatment system 16 has been completed, dam 34 is simply lifted out of the swimming pool 10 and fluid communication between the water in the swimming pool 10 and the water treatment system 16 is re-established via intake/return port 20. Water can also be removed from dam 34 by simply opening return port 32 and draining the water from dam 34.

In one form of the dam 34, the dimension of top rim or edge 38 between sides $38S_1$ and $38S_2$ is 32", the dimension of the dam between the top edge 38 and the bottom 54 is 18" and the radius 52R of top edge 52 is 16" as measured between the plane containing port 42 and top rim 52. Top rim 52 can be a rolled configuration if suitable.

It is understood that while certain forms of the present invention have been illustrated and described herein, it is not to be limited to the specific forms or arrangements of parts described and shown.

I claim:

1. A swimming pool accessory comprising:

a) a planar first wall that abuts a swimming pool side wall adjacent to a water treatment system intake/return when said first planar wall is in position, said planar first wall including (1) a port which is fluidically aligned with the intake/return of the water treatment system when said planar first wall is in position, and (2) a seal on said planar first wall in surrounding relationship with said port, said seal including a linear top rim and a semi-circular side rim, b) a second wall fixed to said planar first wall, said second wall being approximately quarter-spherical in shape and being fixed to said planar first wall along a first peripheral edge of said second wall and extending radially outwardly from said planar first wall along a second peripheral edge of said second wall, said second wall being fluidically interposed between water in the swimming pool and the intake/return of the water treatment system when said second wall is in place;

c) a top edge along the second peripheral edge of said second wall, said top edge being co-planar with the top rim of said seal; and d) a fluid flow path being defined between said top edge and said port.

2. The swimming pool accessory defined in claim 1 wherein said second wall is corrugated in shape.

3. The swimming pool accessory defined in claim 2 wherein said seal is constructed of rubber.

4. The swimming pool accessory defined in claim 3 wherein said port covers essentially the entire first wall.

5. A swimming pool water treatment system comprising:

a) a swimming pool side wall;

b) a body of water contained by said swimming pool side wall and having a water level;

c) a water treatment system fluidically connected to said body of water and including (1) an intake/return port in said swimming pool side wall, (2) a filter fluidically connected to said intake/return port, (3) a pump fluidically connected to the filter;

d) a dam releasably fixed to said swimming pool side wall adjacent to the intake/return port of said water treatment system, said dam fluidically isolating the intake/return port of said water treatment system from water in said body of water, said dam including (1) a first planar wall, (2) a seal releasably mounting said first planar wall on said swimming pool side wall surroundingly adjacent to the intake/return port of said water treatment system, (3) a fluid port through said first planar wall and located to be in fluid communication with the intake/return port of said water treatment system, said fluid port covering essentially the entire area of said first planar wall, (4) a water-impervious wall fixed to said first planar wall, said water-impervious wall being in the approximate shape of a quarter-sphere and being corrugated and having a top rim which is arcuate and defines a fluid opening that is fluidically connected to the fluid port of said dam, the top rim of said water-impervious wall extending radially away from said first planar wall, (5) said top rim being located above the water level of said body of water, and (6) a bottom rim on said first planar wall located beneath said intake/return port.

* * * * *